US008414427B2

(12) United States Patent
Nakagawa et al.

(10) Patent No.: US 8,414,427 B2
(45) Date of Patent: Apr. 9, 2013

(54) GOLF BALL

(75) Inventors: Takuma Nakagawa, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 674 days.

(21) Appl. No.: 12/511,831

(22) Filed: Jul. 29, 2009

(65) Prior Publication Data

US 2011/0028245 A1 Feb. 3, 2011

(51) Int. Cl.
*A63B 37/12* (2006.01)

(52) U.S. Cl.
USPC ..... 473/383

(58) Field of Classification Search ..... 473/383–385
See application file for complete search history.

(56) References Cited

U.S. PATENT DOCUMENTS 7,364,515 B2 * 4/2008 Kasashima ..... 473/383
2006/0073915 A1 * 4/2006 Aoyama ..... 473/378

FOREIGN PATENT DOCUMENTS

JP 2004-105200 A 4/2004
JP 2004-141467 A 5/2004

* cited by examiner

*Primary Examiner* — Raeann Gorden
(74) *Attorney, Agent, or Firm* — Sughrue Mion, PLLC

(57) ABSTRACT

A golf ball has uniform gaps between dimples even if the surface occupancy ratio of the dimples is high, and therefore the aerodynamic performance thereof is improved, whereby a longer flight distance can be obtained. In the golf ball having a plurality of dimples and land parts surrounded by the plurality of dimples, the land part has a shape having at least one vertex, the land part is connected to at least two adjacent land parts substantially by a point, and the area of the land part is in the range of about 0.05 $mm^2$ to about 16.0 $mm^2$.

20 Claims, 4 Drawing Sheets

GOLF BALL

BACKGROUND OF THE INVENTION

The present invention relates to a golf ball and, more particularly, relates to a golf ball formed with dimples and lands on the surface thereof to increase the flight distance.

It has been well known that in designing a golf ball, the high resilience performance that the golf ball itself has and a decrease in air resistance during flight caused by the dimples arranged on the surface of the golf ball are of importance in obtaining a long flight distance when the golf ball is hit. Usually, a large number of dimples is arranged on the surface of a golf ball, and it has been thought that as the surface occupancy ratio of the dimples increases, the aerodynamic performance of golf ball is improved. Therefore, to improve aerodynamic performance, various methods for arranging dimples on the surface of golf ball at a high density have been proposed.

Usually, in designing the dimples of a golf ball, there has been used a method in which dimples having predetermined one or a plurality of shapes are arranged on the surface of the golf ball. In the method in which dimples having such predetermined shapes are arranged, however, if the surface occupancy ratio of the dimples increases greatly, it is difficult to arrange the dimples uniformly because the surface of the golf ball is spherical. Therefore, locations in which a gap between dimples widens or narrows are produced, and the gap between dimples often is nonuniform. If the gap between dimples is nonuniform, there is a possibility that the aerodynamic performance of the golf ball will be extremely poor even if the surface occupancy ratio of the dimples is high.

Japanese Unexamined Patent Application Publication No. 2004-105200 and Japanese Unexamined Patent Application Publication No. 2004-141467 disclose techniques in which ridge-shaped protrusions are formed on the surface of a golf ball, the techniques being entirely different from the conventional idea that a large number of dimples are formed at the surface of a golf ball. By forming the ridge-shaped protrusions in this manner, the occupancy ratio of portions having no protrusions, which corresponds to the conventional surface occupancy ratio of the dimples, can be increased easily, and thereby the aerodynamic performance can be improved.

SUMMARY OF THE INVENTION

An object of the present invention is to provide a golf ball in which a gap between dimples can be kept uniform even if the surface occupancy ratio of the dimples is high, and therefore the aerodynamic performance thereof is improved, whereby a longer flight distance can be obtained.

To achieve the above object, the present invention provides a golf ball having a plurality of dimples and land parts surrounded by the plurality of dimples, wherein the land part has a shape having at least one vertex, the land part is connected to at least two adjacent land parts substantially by a point, and the area of the land part is in the range of about 0.05 $mm^2$ to about 16.0 $mm^2$.

As one aspect of the present invention, the land part can have a substantially concave polygonal shape having at least three vertexes. The land part of the substantially concave polygonal shape can be connected to the adjacent land part substantially by a point at the vertex. The two adjacent land parts can be connected to each other at the vertex. The land part of the substantially concave polygonal shape can be connected to the adjacent land parts at all or some vertexes thereof. The length of the outer periphery of the land part can be in the range of about 1.6 mm to about 19.4 mm. Also, the length of the outer periphery of the dimple can be in the range of about 3.2 mm to about 38.8 mm.

As another aspect of the present invention, the land part has a shape which is in contact with the inside of a triangle. As the shape inscribed in such a triangle, for example, a heart shape is available. The land part having the shape inscribed in this triangle can be connected to the adjacent land part substantially by a point at least one vertex. The length of the outer periphery of the dimple can be in the range of about 3.2 mm to about 38.8 mm.

In the present invention, the surface of the dimple can be a smoothly curved surface extending at least from the outer periphery thereof toward the center. The whole surface of the dimple can be the smoothly curved surface. One of the dimples can be arranged so as to be connected to four or more land parts. One of the dimples can be arranged so as to be connected to six or fewer land parts. The surface occupancy ratio of the dimples is preferably about 70% or more. Also, the surface occupancy ratio of dimples is preferably about 80% or more. The number of land parts can be in the range of about 434 to about 863.

DESCRIPTION OF THE PREFERRED EMBODIMENTS

Embodiments of a golf ball in accordance with the present invention will now be described with reference to the accompanying drawings. The present invention is not limited to these embodiments.

Figure 1:
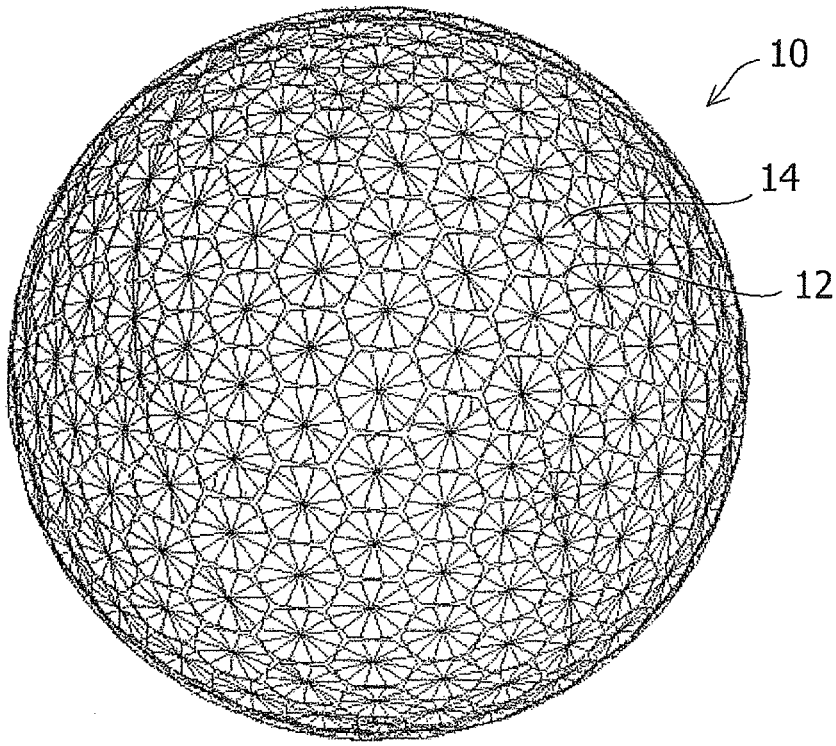
FIG. 1 is an elevational view showing one embodiment of a golf ball in accordance with the present invention.
Figure 2:
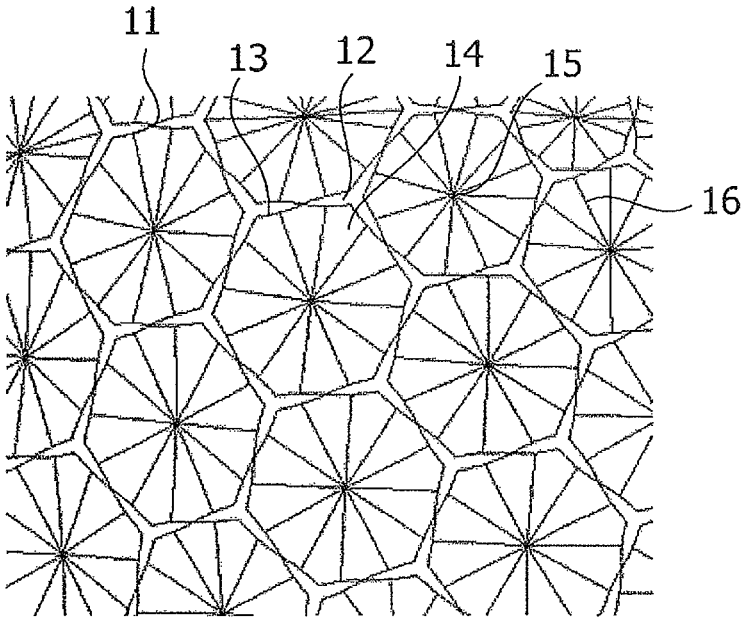
FIG. 2 is an enlarged view of the surface of the golf ball shown in FIG. 1.
Figure 3A:
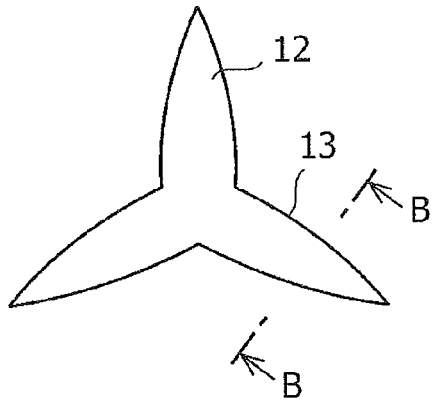
FIG. 3(*a*) is an enlarged view of a land part of the golf ball shown in FIG. 1, and FIG. 3(*b*) is a sectional view of the land part taken along the line B-B of FIG. 3(*a*)
Figure 3B:
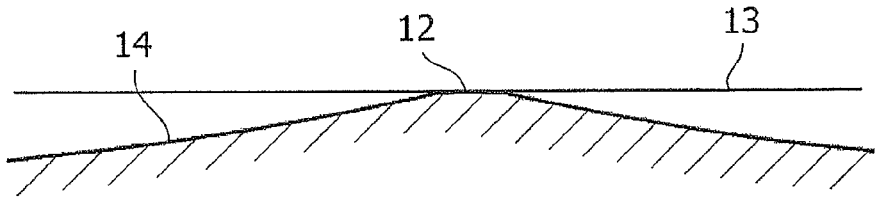

First, an embodiment shown in FIGS. 1 to 3 is explained. As shown in FIGS. 1 and 2, at the surface of a golf ball 10, plural dimples 14 are formed. At the golf ball surface, portions in which no dimples are formed are called land parts 12. A boundary line 13 between the land part 12 and the dimple 14 is sometimes called the outer periphery of the land part 12, or is sometimes called the outer periphery of the dimple 14.

In this embodiment, the shape of the outer periphery 13 of the land part 12 is a substantially concave hexagonal shape having three vertexes 11. In this specification, the term "concave polygonal shape" means a polygonal shape in which at least one of the internal angles thereof is greater than 180 degrees. For example, the term "hexagonal shape" means a polygonal shape having six sides. The "substantially" concave polygonal shape includes a concave polygonal shape in which the sides thereof are curved. Also, in this specification, the "vertex" of a concave polygonal shape means a point located at a corner whose internal angle is less than 180 degrees. Therefore, the substantially concave hexagonal shape of the land part 12 shown in FIG. 2 has three vertexes 11. This substantially concave hexagonal shape having three vertexes is sometimes simply called a star shape having three vertexes.

Around one dimple 14, six land parts 12 are formed. Therefore, the shape of the outer periphery 13 of the dimple 14 is a substantially dodecagonal shape. The side between the vertexes of this substantially dodecagonal shape is curved, and they are not straight. Also, one land part 12 is adjacent to three land parts 12, and the adjacent land parts 12 are connected to each other substantially by a point at the position of the vertex 11.

The area of the land part 12 must be about 0.05 $mm^2$ or more. On the other hand, the area of the land part 12 must be about 16.0 $mm^2$ or less. The area of the land part 12 is preferably about 0.5 $mm^2$ or more, further preferably about 0.62 $mm^2$ or more. Also, the area of the land part 12 is preferably about 8.5 $mm^2$ or less, and further preferably, about 1.65 $mm^2$ or less.

The length of the outer periphery 13 of the land part 12 is preferably about 1.6 mm or more, and further preferably about 4.0 mm or more. Also, the length of the outer periphery 13 of the land part 12 is preferably about 19.4 mm or shorter, further preferably about 9.9 mm or shorter.

The length of the outer periphery 13 of the dimple 14 is preferably about 3.2 mm or longer, and it is further preferably about 6.3 mm or longer. Also, the length of the outer periphery 13 of the dimple 14 is preferably about 38.8 mm or less, and it is further preferably about 19.8 mm or less. By setting the length of the outer periphery 13 of the dimple 14 in the above-described range and by designing the land part as described above, the aerodynamic performance can be improved.

FIG. 3(*a*) is an enlarged view of the land part 12 having a substantially concave hexagonal shape, and FIG. 3(*b*) is a sectional view of the land part 12 taken along the line B-B of FIG. 3(*a*). As shown in FIG. 3(*b*), the surface of the land part 12 forms the spherical surface of the golf ball 10. The surface of the dimple 14 is depressed from an imaginary spherical surface formed by assuming that no dimples are formed in the surface of golf ball, and it has a smooth curved shape extending from the boundary line 13 with the land part 12 toward a center 15 of the dimple 14 positioned at the deepest position of the dimple 14.

As shown in FIG. 2, the surface of the dimple 14 is divided into twelve sections in the circumferential direction. In each of the sections, the surface is smoothly curved from the outer periphery 13 toward the center 15, and on the other hand, a ridge line 16 is formed between the sections.

The depth of the dimple 14 is not subject to any special restriction in the present invention. The depth at the center 15 at the deepest position is, for example, preferably about 0.05 mm or deeper, and further preferably about 0.10 mm or deeper. On the other hand, the depth at the center 15 is preferably about 0.45 mm or shallower, and further preferably about 0.35 mm or shallower.

Thus, the land parts 12 each having a predetermined shape are arranged on the surface of the golf ball 10, the dimples 14 in the golf ball surface are designed, and the plurality of land parts 12 are arranged so that the adjacent land parts 12 are connected to each other substantially by a point. Thereby, even if the ratio of the surfaces of the dimples 14 to the imaginary spherical surface of the golf ball 10, that is, the surface occupancy ratio of the dimples 14 is increased, the gap between the dimples can be made uniform. Thereupon, the aerodynamic performance of the golf ball is improved remarkably, and thereby a longer flight distance can be obtained. Also, by changing the shape of the land part, the surface occupancy ratio of the dimples 14 can be controlled easily.

The surface occupancy ratio of the dimples is preferably about 70% or more, and further preferably about 80% or more. By making the surface occupancy ratio of dimples about 70% or more, the air resistance can be decreased. On the other hand, the surface occupancy ratio of dimples is preferably about 99% or less.

The total number of the land parts 12 formed on the golf ball surface is preferably about 434 or more, and is further preferably about 540 or more. On the other hand, the total number of the land parts 12 is preferably about 864 or less, and is further preferably about 756 or less. By making the total number of the land parts 12 in the above-described range, the surface occupancy ratio of the dimples 14 in the surface of the golf ball 10 can be designed in the above-described preferred range.

The total number of dimples formed in the golf ball surface is determined according to the total number of the land parts and the relationship between the land part and the dimple. For example, in the case in which the total number of land parts is 434, if one dimple is formed by six land parts, the total number of dimples is 218. If one dimple is formed by six land parts similarly, when the total number of land parts is 540, the total number of dimples is 272, when the total number of land parts is 756, the total number of dimples is 380, and when the total number of land parts is 864, the total number of dimples is 434.

Figure 4:
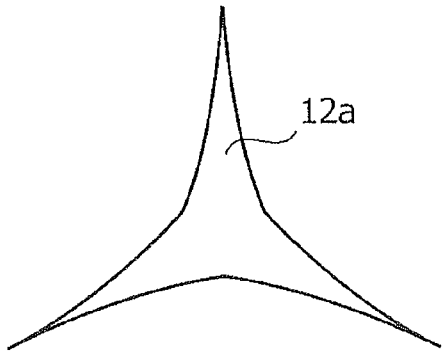
FIG. 4 is an enlarged view showing another example of a land part of a golf ball in accordance with the present invention.
Figure 5:
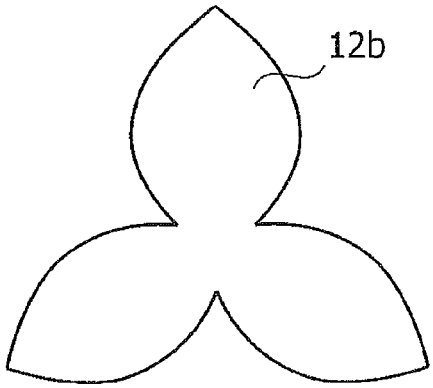
FIG. 5 is an enlarged view showing still another example of a land part of a golf ball in accordance with the present invention.

The shape of the land part 12 shown in FIGS. 1 to 3 is a star shape such that the sides of a concave polygonal shape are curved slightly in a convex shape toward the outside of the land part. However, in another embodiment, the shape of a land part 12*a* can be made a star shape such that the sides of a concave polygonal shape are curved in a concave shape toward the inside of the land part as shown in FIG. 4. Also, the shape of land part 12*b* can be made a shape such that the sides of a concave polygonal shape are curved greatly in a convex shape toward the outside of the land part, as shown in FIG. 5. In the latter case, the shape of the land part 12*b* would be appropriately called a three-leafed clover shape rather than a star shape.

Also, FIGS. 1 to 5 show examples in which the shape of the land part is a substantially concave hexagonal shape having three vertexes. However, the present invention is not limited to this shape. The shape of the land part can be made a substantially concave n×2 angled shape (n is a natural number of three or more) having n number of vertexes, such as a substantially concave octagonal shape having four vertexes or a substantially concave decagonal shape having five vertexes.

Furthermore, FIGS. 1 to 5 show examples in which all of the land parts and dimples formed on the surface of golf ball have the same shape. However, the present invention is not limited to this configuration. The land parts having a plurality of shapes or the dimples having a plurality of shapes can also be formed. For example, FIG. 6 shows the surface of a golf ball in which dimples are formed by using land parts having three kinds of shapes.

Figure 6:
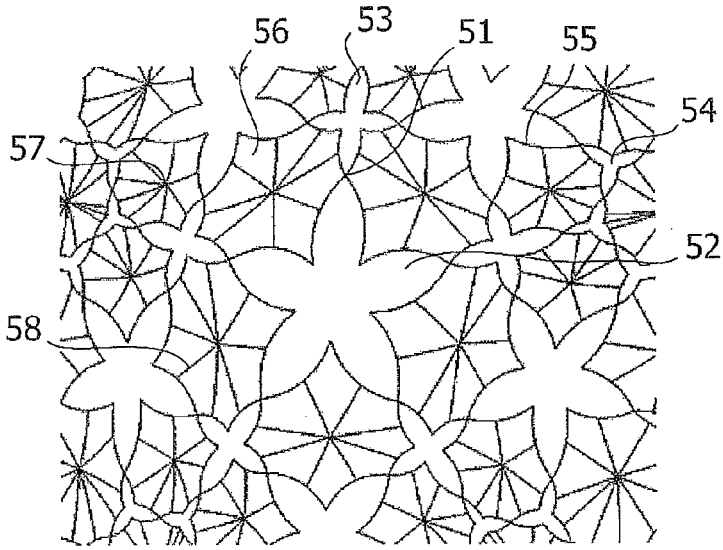
FIG. 6 is an enlarged view of the surface of another embodiment of a golf ball in accordance with the present invention.

As shown in FIG. 6, in this embodiment, first land parts 52 of a substantially concave decagonal shape having five vertexes, second land parts 53 of a substantially concave octagonal shape having four vertexes, and third land parts of a substantially concave hexagonal shape having three vertexes are formed. The first, second, and third land parts 52, 53 and 54 each are adjacent to the land parts having the same number as the number of vertexes that the respective land parts 52, 53 and 54 have. The adjacent land parts 52, 53 and 54 are connected to each other substantially by a point at the position of a vertex 51.

Also, around one dimple 56, four land parts 52, 53, 54 are formed. Thereby, the shape of an outer periphery 55 of the dimple 56 is made substantially octagonal. All of the shapes of the substantial octagons are not the same. Plural deformed substantially octagonal dimples 56, such as those having different sizes, or those being slenderly distorted, are formed. In any of the substantially octagonal dimples 56, a smoothly curved surface is formed from the outer periphery 55 toward a center 57 positioned at the deepest position. Also, the surface of the dimple 56 is divided into eight sections in the circumferential direction, and a ridge line 58 is formed between the sections.

Even if the dimples 56 having a plurality of shapes are formed by using the land parts 52, 53, 54 having a plurality of shapes in this manner, the gap between the dimples 56 can be made uniform as viewed from the overall golf ball, and the surface occupancy ratio of the dimples 56 can be controlled easily.

Regarding the shape of the land part, if a substantially concave polygonal shape having a plurality of vertexes is used, the arrangement of the land parts, the design of the dimples, and the surface occupancy ratio of the dimples can be controlled easily. However, the present invention is not limited to this configuration. As far as the shape of the land part has at least one vertex, large numbers of land parts are arranged so as to be connected to at least two or more adjacent land parts substantially by a point, and the gap between the dimples can be made uniform easily.

Figure 7:
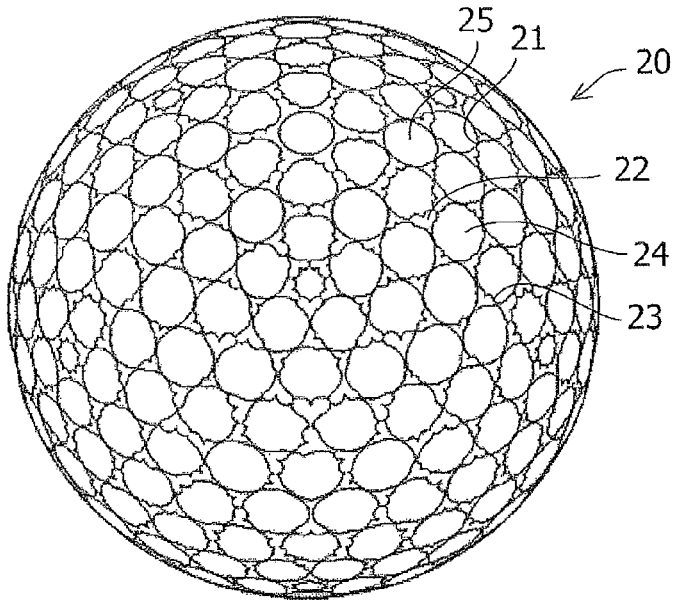
FIG. 7 is an elevational view showing still another embodiment of a golf ball in accordance with the present invention.

For example, in an embodiment shown in FIG. 7, a heart-shaped land part 22 is formed on the surface of a golf ball 20. Since the heart-shaped land part 22 has one vertex 21, this vertex 21 is arranged so as to be connected to the outer periphery 23 other than the vertex of the adjacent heart-shaped land part 22 substantially by a point, whereby one land part is connected to at least two adjacent land parts substantially by a point, respectively.

In this embodiment, around one dimple 24, six heart-shaped land parts 22 are formed. Also, one heart-shaped land part 22 is adjacent to three heart-shaped land parts 22. Therefore, at the position of the outer periphery 23 of the land part, not the vertex 21, the adjacent heart-shaped land parts 22 are connected to each other substantially by a point.

By the above-described arrangement of land parts, the dimple surrounded by the heart-shaped land parts 22 is usually made the noncircular dimple 24. However, by utilizing the curved part of the heart shape wisely, a circular dimple 25 can be formed. Thus, the dimple formed on the surface of the golf ball in accordance with the present invention is not limited to a noncircular dimple, and a circular dimple can also be employed in the present invention.

Figure 8:
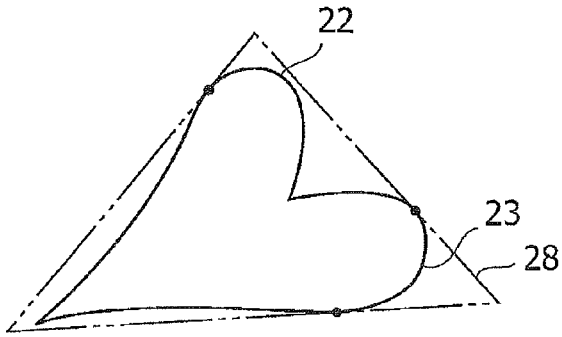
FIG. 8 is an enlarged view of a land part of the golf ball shown in FIG. 7.

In the case in which the land part 22 has a shape having at least one vertex, such as a heart shape, as shown in FIG. 8, the shape of the land part 22 is preferably a shape that is in contact with the inside of a triangle 28. By making the shape of the land part 22 a shape inscribed in the triangle 28 as described above, the land parts and dimples can be arranged and designed symmetrically on the spherical golf ball surface, and the surface occupancy ratio of dimples can be controlled easily.

In the case in which the land part 22 has the heart shape as described above as well, the area of the land part 22 must be within the range of about 0.6 $mm^2$ to about 16.0 $mm^2$ as in the case of the substantially concave polygonal shape. The area of the land part 22 is preferably about 0.5 $mm^2$ or more, and is further preferably about 0.62 $mm^2$ or more. Also, the area of the land part 22 is preferably about 8.5 $mm^2$ or less, and is further preferably about 1.65 $mm^2$ or less.

The length of the outer periphery 23 of the land part 22 is preferably about 1.6 mm or longer, and is further preferably about 4.0 mm or longer as in the case of the substantially concave polygonal shape. Also, the length of the outer periphery 23 of the land part 22 is preferably about 19.4 mm or shorter, and is further preferably about 9.9 mm or shorter.

The length of the outer periphery 23 of the dimple 24 is preferably about 3.2 mm or longer, and is further preferably about 6.3 mm or longer as in the case of the substantially concave polygonal shape. Also, the length of the outer periphery 23 of the dimple 24 is preferably about 38.8 mm or shorter, and is further preferably about 19.8 mm or shorter.

In the case in which the land part 22 has the heart shape as well, the surface of the dimple 24 has a smoothly curved shape extending from the boundary line 23 with the land part 22 toward the center 57 of the dimple 24 positioned at the deepest position of the dimple 24. The depth of the dimple 24 is preferably about 0.05 mm or deeper, and is further preferably about 0.10 mm or deeper at the deepest position as in the case of the substantially concave polygonal shape. Also, the depth of the dimple 24 is preferably about 0.45 mm or shallower, and is further preferably about 0.35 mm or shallower.

The structure of the golf ball may be of a one-piece type or may be of a multiple-piece type consisting of two or more pieces. In particular, the dimples of the present invention can be used effectively on a multiple-piece golf ball that provides low spin. To obtain a golf ball that increases the flight distance, is invulnerable to wind, and provides a long run when the ball is hit by a golf club capable of achieving a long carry, such as a No. 1 wood club (driver), the balance between the lift and drag of a hit ball should be proper. The balance between the lift and drag of a hit ball depends on the structure of and material used for the golf ball, and in particular, depends on the shape, area, and total number of the used land parts, the surface occupancy ratio of dimples, and the like.

The golf ball in accordance with the present invention can be manufactured by using a mold. To prepare such a mold, there may be employed either a process of directly machining an entire surface configuration three-dimensionally in a reverse master mold or a process of directly machining a cavity part three-dimensionally in a molding die, both with the aid of a 3D CAD or CAM system. By designing the mold so that the parting line of the mold passes through the land parts on the golf ball surface, the finishing (trimming) work can be made easy. Also, to develop the land parts on the spherical surface of the golf ball without deviation, the arrangement method of polygons such as icosahedrons, dodecahedrons, and octahedrons, three-fold symmetry, five-fold symmetry, and the like is preferably used.

EXAMPLE

For the golf ball of the embodiment shown in FIG. 1, the surface occupancy ratio of dimples thereof was calculated. The substantially hexagonal land part having three vertexes had an average area of 0.94 $mm^2$ and an average outer periphery of 7.0 mm. The total number of land parts was 648. As a result, the surface occupancy ratio of dimples was 89.5%.

Also, for golf balls having the shapes of land parts shown in FIGS. 4 and 5, the surface occupancy ratio of dimples thereof was calculated. The land part shown in FIG. 4 had an average area of 0.53 $mm^2$ and an average outer periphery of 6.6 mm. The total number of land parts was 648. As a result, the surface occupancy ratio of dimples was 94%. The land part shown in FIG. 5 had an average area of 1.42 $mm^2$ and an average outer periphery of 7.5 mm. The total number of land parts was 648. As a result, the surface occupancy ratio of dimples was 84%.

For the golf ball of the embodiment shown in FIG. 7, the heart-shaped land part had an average area of 1.98 $mm^2$ and an average outer periphery of 8.0 mm, and the total number thereof was 648. As a result, the surface occupancy ratio of dimples was 77.6%.

On the other hand, for comparison, for the conventional golf ball having circular dimples only, the surface occupancy ratio of dimples thereof was calculated. The total number of the circular dimples was 398. As a result, the surface occupancy ratio of dimples was 74.5%.

Figure 9:
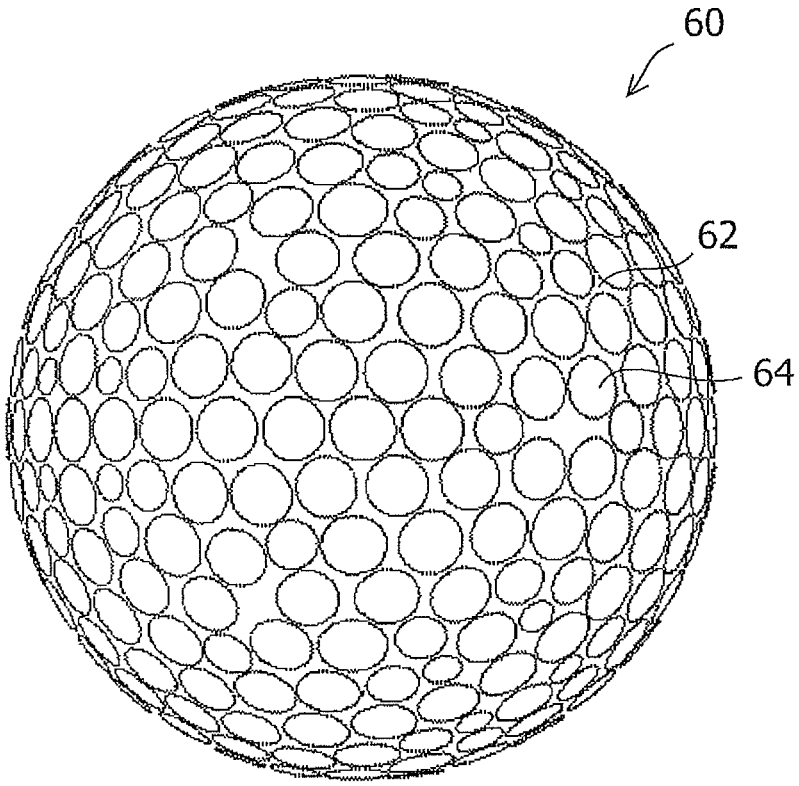
FIG. 9 is an elevational view of a golf ball of a comparative example.

The flight distance at the time when the golf balls shown in FIGS. 1, 7, and 9 were hit by using a driver under the conditions that the initial speed was 66 mm/s, the delivery angle was 10.5 degrees, and the back spin was 2700 rpm was measured. The results are given in Table 1.

TABLE 1

| Shape of land part | Surface occupancy ratio (%) | Average depth (mm) | Carry (m) | Total (m) |
|---|---|---|---|---|
| Star shape (FIG. 1) | 85.5 | 0.238 | 215.34 | 235.47 |
| Heart shape (FIG. 7) | 77.6 | 0.257 | 216.62 | 235.34 |
| Conventional (FIG. 9) | 74.5 | 0.247 | 214.45 | 234.43 |

As given in Table 1, for the golf ball having star-shaped land parts shown in FIG. 1, in which the surface occupancy ratio was as high as about 85%, the flight distance of the golf ball increased by about 1 m in both of carry and total as compared with the conventional golf ball having circular dimples shown in FIG. 9, in which the surface occupancy ratio was about 75%. Also, for the golf ball having heart-shaped land parts shown in FIG. 7, in which the surface occupancy ratio was about 78%, as compared with the conventional golf ball shown in FIG. 9, the flight distance increased by about 2 m in carry and about 1 m in total though the surface occupancy ratio was only 3% high.

What is claimed is:

1. A golf ball comprising:

plural dimples comprising noncircular dimples;

and land parts surrounded by the plural dimples, wherein each of the land parts has a shape having at least one vertex which is formed by at least one the noncircular dimple, each of the land parts is connected to at least two adjacent land parts substantially by a point, and each area of the land parts is in the range of about 0.05 $mm^2$ to about 16.0 $mm^2$.

2. The golf ball according to claim 1, wherein the land part has a substantially concave polygonal shape having at least three vertexes.

3. The golf ball according to claim 2, wherein the land part of the substantially concave polygonal shape is connected to the adjacent land part substantially by a point at the vertex.

4. The golf ball according to claim 2, wherein the length of an outer periphery of the land part is in the range of about 1.6 mm to about 19.4 mm.

5. The golf ball according to claim 2, wherein the length of an outer periphery of the dimple is in the range of about 3.2 mm to about 38.8 mm.

6. The golf ball according to claim 2, wherein the surface of the dimple is a smoothly curved surface extending at least from an outer periphery thereof toward a center.

7. The golf ball according to claim 2, wherein one of the dimples is connected to at least four land parts.

8. The golf ball according to claim 2, wherein one of the dimples is connected to not more than six land parts.

9. The golf ball according to claim 2, wherein the surface occupancy ratio of dimples is at least about 70%.

10. The golf ball according to claim 9, wherein the surface occupancy ratio of dimples is at least about 80%.

11. The golf ball according to claim 2, wherein the number of land parts is in the range of about 434 to about 863.

12. The golf ball according to claim 1, wherein the land part has a shape which is in contact with the inside of a triangle.

13. The golf ball according to claim 12, wherein the length of an outer periphery of the dimple is in the range of about 3.2 mm to about 38.8 mm.

14. The golf ball according to claim 12, wherein the surface of the dimple is a smoothly curved surface extending at least from an outer periphery thereof toward a center.

15. The golf ball according to claim 12, wherein one of the dimples is connected to at least four land parts.

16. The golf ball according to claim 12, wherein one of the dimples is connected to not more than six land parts.

17. The golf ball according to claim 12, wherein the surface occupancy ratio of dimples is at least about 70%.

18. The golf ball according to claim 12, wherein the surface occupancy ratio of dimples is at least about 80%.

19. The golf ball according to claim 2, wherein the number of land parts is in the range of about 434 to about 863.

20. The golf ball according to claim 1, wherein the perimeter of each land part is defined by a dimple edge portion.

* * * * *